US011078634B2

(12) United States Patent
Taran

(10) Patent No.: US 11,078,634 B2
(45) Date of Patent: Aug. 3, 2021

(54) VARIABLE TAMPER BAR AMPLITUDE FOR ASPHALT PAVERS

(71) Applicant: Caterpillar Paving Products Inc., Brooklyn Park, MN (US)

(72) Inventor: Vitaly Y. Taran, Dubai (AE)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 86 days.

(21) Appl. No.: 16/674,387

(22) Filed: Nov. 5, 2019

(65) Prior Publication Data

US 2021/0131044 A1 May 6, 2021

(51) Int. Cl.

| | |
|---|---|
| ***E01C 19/00*** | (2006.01) |
| ***E01C 19/40*** | (2006.01) |
| ***E01C 19/38*** | (2006.01) |
| ***E01C 19/48*** | (2006.01) |

(52) U.S. Cl.
CPC ..... *E01C 19/405* (2013.01); *E01C 19/38* (2013.01); *E01C 19/486* (2013.01)

(58) Field of Classification Search
CPC ..... E01C 19/38; E01C 19/405; E01C 19/486
USPC ..... 404/72, 75, 118, 133.05–133.2
See application file for complete search history.

(56) References Cited

U.S. PATENT DOCUMENTS 1,982,387 A * 11/1934 Heltzel ..... E01C 19/10 404/75
2,818,791 A * 1/1958 Kennedy, III ..... E01C 19/34 404/133.2
3,802,791 A * 4/1974 Uebel ..... E02D 3/068 404/133.1
4,005,944 A * 2/1977 Harris ..... E02D 3/068 404/133.2
4,439,057 A * 3/1984 Sprague ..... E02D 3/046 173/205
4,828,428 A * 5/1989 Anderson ..... E01C 19/407 404/102
5,947,638 A * 9/1999 Heims ..... E01C 19/407 404/102
6,551,018 B2 * 4/2003 Baker ..... E01C 19/407 404/102
10,030,339 B2 * 7/2018 Martin ..... E01C 19/17
2002/0141823 A1 * 10/2002 Baker ..... E01C 19/407 404/102
2009/0047069 A1 * 2/2009 Herrmann ..... E01C 19/008 404/75
2011/0002737 A1 * 1/2011 Mahler ..... E01C 19/4833 404/118

(Continued)

FOREIGN PATENT DOCUMENTS

| | | |
|---|---|---|
| DE | 102017202461 | 8/2017 |
| EP | 2599918 | 2/2014 |

*Primary Examiner* — Raymond W Addie
(74) *Attorney, Agent, or Firm* — Schwegman, Lundberg & Woessner

(57) ABSTRACT

A paving machine can include a frame; a screed assembly coupled to the frame; and a tamper bar assembly located on the screed assembly, wherein the tamper bar assembly includes a connecting rod configured to have a reciprocating up and down motion; a plate connected to a lower end of the connecting rod; and a tamper bar positioned beneath the plate, wherein the tamper bar is coupled to the plate by one or more dampening members extending between the tamper bar and the plate.

20 Claims, 4 Drawing Sheets

(56) References Cited

U.S. PATENT DOCUMENTS

2011/0123270 A1* 5/2011 Buschmann ..... F16C 3/28
404/133.05

* cited by examiner

VARIABLE TAMPER BAR AMPLITUDE FOR ASPHALT PAVERS

TECHNICAL FIELD

The present disclosure generally relates to an asphalt paving machine. More particularly, the present disclosure relates to a paving machine having a tamper bar assembly.

BACKGROUND

Paving machines are used to apply, spread and compact paving material relatively evenly over a desired surface. These machines are regularly used in the construction of roads, parking lots and other areas where a smooth durable surface is required for cars, trucks and other vehicles to travel. An asphalt paving machine generally includes a hopper for receiving asphalt material from a truck and a conveyor system for transferring the asphalt rearwardly from the hopper for discharge onto a roadbed. Screw augers may be used to spread the asphalt transversely across the roadbed in front of a screed plate. The screed plate smooths and somewhat compacts the asphalt material and ideally leaves a roadbed of uniform depth and smoothness.

Although the screed plate compacts the asphalt material to some extent, it may be desirable to pre-compact the asphalt material prior to its engagement by the screed plate. A tamper mechanism may be positioned between the screw auger and the screed plate to perform such pre-compacting operation. Tamper mechanisms often includes a tamper bar, located in front of the screed plate relative to the direction of travel of the paving machine and extending transversely to the direction of travel. The tamper bar moves up and down, striking the asphalt material on each downward stroke to compact the asphalt material.

The quality of the paving job can be improved on many jobsites by changing the amplitude of the tamper bar depending on the thickness of the paving mat. Some paving machines have an option to change the amplitude of the tamper bar manually, but it can take a long time to do this job. Also, the tamper bar position is usually adjusted after changing the amplitude, and this job will take some time as well. Totally a customer may need more than two hours to prepare the screed to work with new amplitude. Because of this, users rarely change the amplitude and almost all the time screeds work with the same, default tamper bar amplitude.

DE 102017202461 discusses a screed assembly having adjustable amplitude of the tamping system.

SUMMARY

In an example according to this disclosure, a paving machine can include a frame; a screed assembly coupled to the frame; and a tamper bar assembly located on the screed assembly, wherein the tamper bar assembly includes: a connecting rod configured to have a reciprocating up and down motion; a plate connected to a lower end of the connecting rod; and a tamper bar positioned beneath the plate, wherein the tamper bar is coupled to the plate by one or more dampening members extending between the tamper bar and the plate.

In one example, a screed assembly can include a screed frame; a screed plate coupled to the screed frame; and a tamper bar assembly coupled to the screed frame, wherein the tamper bar assembly includes: a connecting rod configured to have a reciprocating up and down motion; a plate connected to a lower end of the connecting rod; and a tamper bar positioned beneath the plate, wherein the tamper bar is coupled to the plate by one or more dampening members extending between the tamper bar and the plate.

In one example, a method of adjusting amplitude for a tamper bar can include providing a screed assembly including a tamper bar assembly, wherein the tamper bar assembly includes a connecting rod configured to have a reciprocating up and down motion, a plate connected to a lower end of the connecting rod, and a tamper bar positioned beneath the plate; and coupling the tamper bar to the plate by connecting one or more dampening members between the plate and the tamper bar.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1:
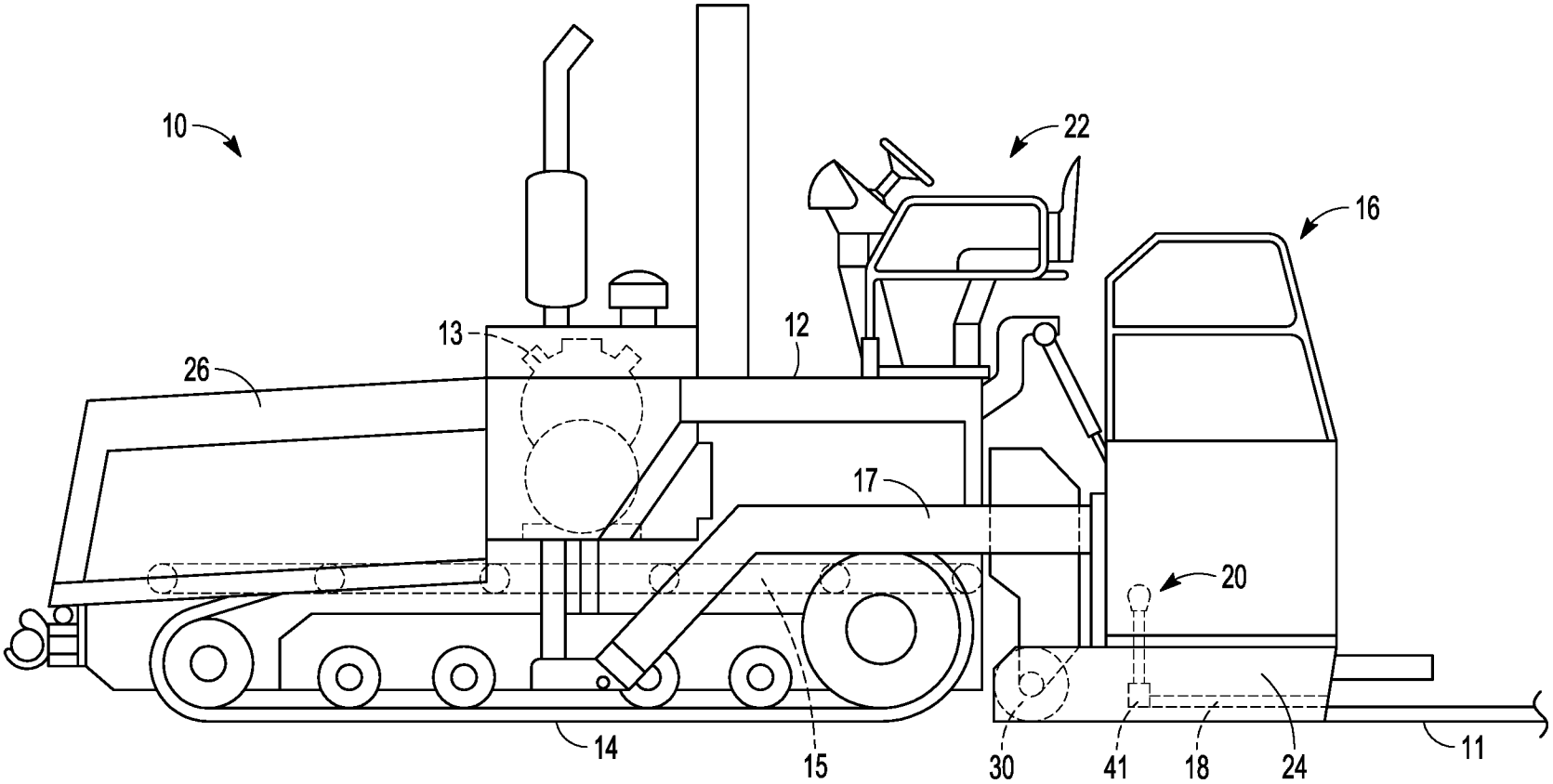
FIG. 1 shows a side view of a paving machine, in accordance with one embodiment.

FIG. 1 shows a side view of a paving machine 10 in accordance with one embodiment. The paving machine 10 generally includes a frame 12 with a set of ground-engaging elements 14 such as tracks or wheels coupled with the frame 12. The ground-engaging elements 14 may be driven by an engine 13 in a conventional manner. A screed assembly 16 can be positioned at the rear end of the paving machine 10 to spread and compact paving material into an asphalt mat 11 having a desired thickness, size, uniformity, crown profile and cross slope. The paving machine 10 also includes an operator station 22 having a seat and a console, which includes various controls for directing operations of the paving machine 10.

The paving machine 10 further includes a hopper 26 for storing a paving material, and a conveyor system including one or more conveyors 15 configured to move paving material from the hopper 26 to the screed assembly 16 at the rear of the paving machine 10. One or more augers 30 are arranged near the forward end of the screed assembly 16 to receive the paving material supplied by the conveyor 15 and spread the material evenly beneath the screed assembly 16.

Reference to the "forward" end of the screed assembly 16 means the end of screed assembly 16 facing in the direction of travel of paving machine 10 as paving machine 10 is applying the paving material to a surface (to the left in FIG. 1). Similarly, reference to a "forward-facing" surface of a component of screed assembly 16 means a surface facing in the direction of travel of paving machine 10 while paving machine 10 is applying paving material to a surface, while reference to an "aft-facing" surface of a component means a surface facing away from the direction of travel of paving machine 10 while paving machine 10 is applying paving material to a surface (to the right in FIG. 1).

The screed assembly 16 can be pivotally coupled behind the paving machine 10 by a pair of tow arms 17 that extend between the frame 12 of the paving machine and the screed assembly 16. The tow arms 17 can be pivotally connected to the frame 12 such that the relative position and orientation of the screed assembly 16 relative to the screed frame and to the surface being paved may be adjusted by pivoting the tow arms 17, for example, in order to control the thickness of the paving material deposited by the paving machine 10.

The screed assembly 16 can include a screed frame 24 with a screed plate 18 coupled to the screed frame 24. The screed plate 18 is configured to float on the paving material of the asphalt mat 11 laid upon a prepared paving bed and to "smooth" or level and compact the paving material on the base surface, such as for example a roadway or roadbed.

The screed assembly 16 can include a tamper bar assembly 20 positioned forward of the screed plate 18 and extending transversely to the direction of travel of the paving machine 10. The tamper bar assembly 20 may include a tamper bar 41. Tamper bar assembly 20 can be coupled to the screed frame 24 of screed assembly 16 and configured such that the tamper bar 41 is reciprocated in an upward and downward direction substantially perpendicular to the asphalt mat 11 and substantially perpendicular to the direction of travel of paving machine 10. Tamper bar 60 extends generally transverse to the paving direction over substantially the entire width of the screed plate 18. The tamper bar assembly 20 pre-compacts the paving material as the paving machine 10 moves forward and the screed assembly 16 smooths the paving material to remove air pockets and other voids to create a flat, paved surface.

As noted above, the quality of a paving job can be improved on many jobsites by changing the amplitude of the tamper bar 41 depending on the thickness of the paving mat. Although, some paving machines have an option to change the amplitude of the tamper bar manually, it can take a long time to do this, so users rarely change the amplitude and almost all the time screeds work with the same, default tamper bar amplitude.

Thus, adjusting tamper bar amplitude on a screed to suit the material being compacted can provide better performance. The same situation happens when the customer changes from normal paving thickness to big thickness (aggregate paving for example). Increasing tamper bar amplitude would allow the screed to work with smaller angle of attack, thus reducing the screed plates wear. The compaction degree after the screed could be increased as well.

As will be further discussed below, the present system allows the amplitude to be changed easily and automatically.

Figure 2:
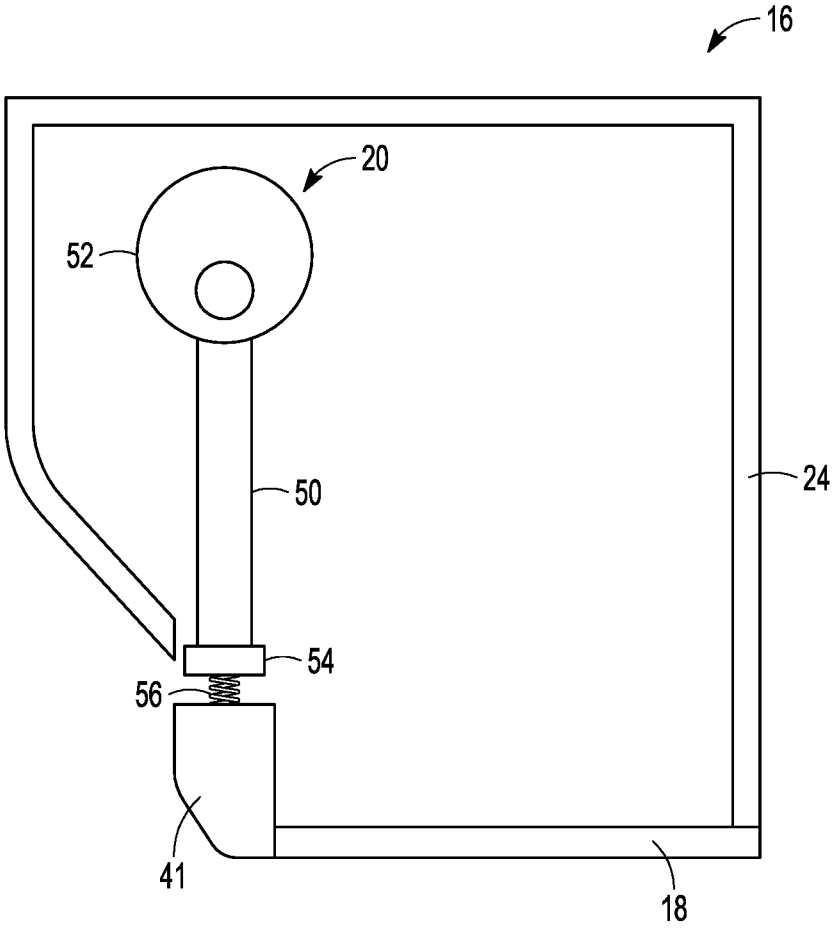
FIG. 2 shows aside view of a portion of a screed assembly, in accordance with one embodiment.

FIG. 2 shows a side view of a portion of the screed assembly 16, in accordance with one embodiment. In this example, the tamper bar assembly 20 can include a connecting rod 50 configured to have a reciprocating up and down motion. For example, the connecting rod 50 can be driven by an eccentric rotating shaft 52. Other examples may use hydraulics connected to the connecting rod 50 to provide the reciprocating motion.

A plate 54 can be connected to a lower end of the connecting rod 50. The tamper bar 41 is positioned and located beneath the plate 54. The tamper bar 41 is coupled to the plate 54 by one or more dampening members 56 extending between the tamper bar 41 and the plate 54.

When the tamper bar assembly 20 is in operation, the rotation of the eccentric rotating shaft 52 forces the connecting rod 50 to move up-down together with the plate 54. The plate 54 thus moves with a constant amplitude as defined by the eccentric shaft. However, the plate 54 moves the tamper bar 41 through the dampening members 56.

Here, the tamper bar 41 is connected to the connecting rods 50 not rigidly, but through the dampening members 56. The dampening members 56 absorb some force created by the tamper bar 41. This action allows for automatic amplitude adjustment of the tamper bar 41 depending on the hardness of the material being compacted, and without requiring any action from the operator.

In one example, the one or more dampening members 56 are directly connected to both the plate 54 and the tamper bar 41 and there is no other connection between the tamper bar 41 and the plate 54 except the dampening member 56.

In one example, the dampening members 56 can include one or more springs. In other examples, dampening members 56 can be other dampening mechanisms.

Figure 3:
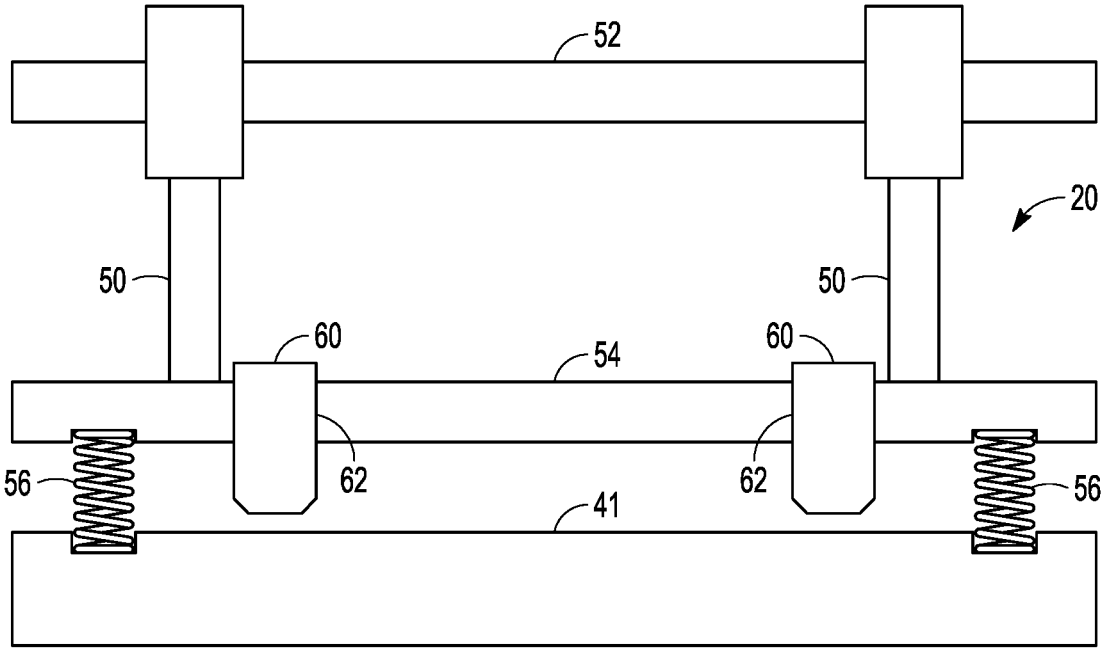
FIG. 3 shows front view of a tamper bar assembly, in accordance with one embodiment.
Figure 4:
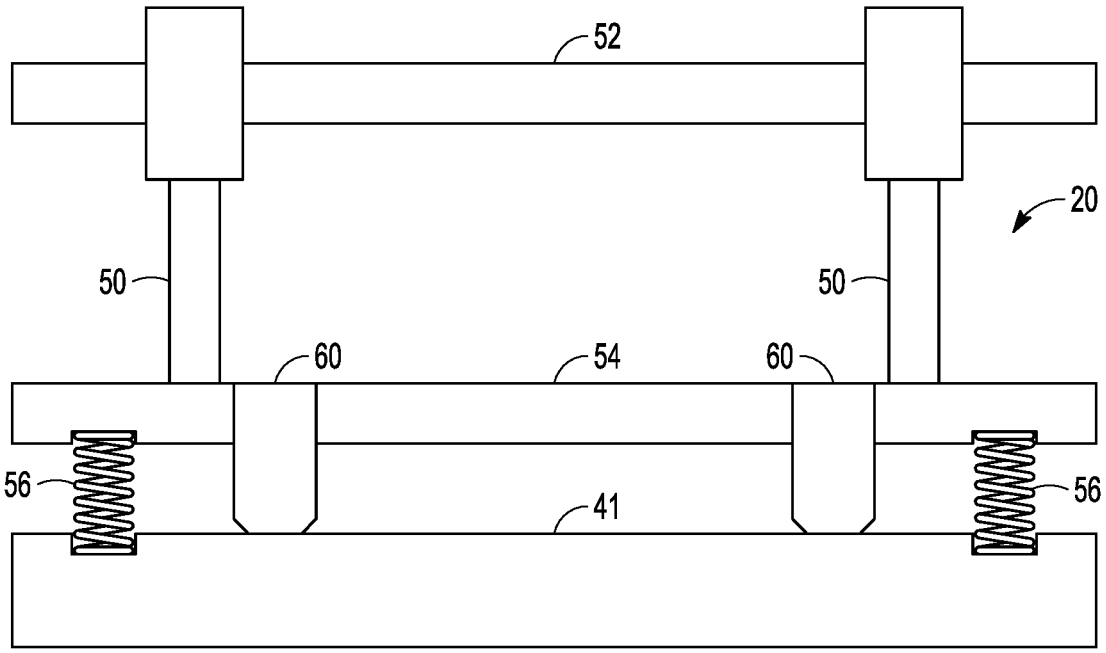
FIG. 4 shows front view of a tamper bar assembly, in accordance with one embodiment.
Figure 5:
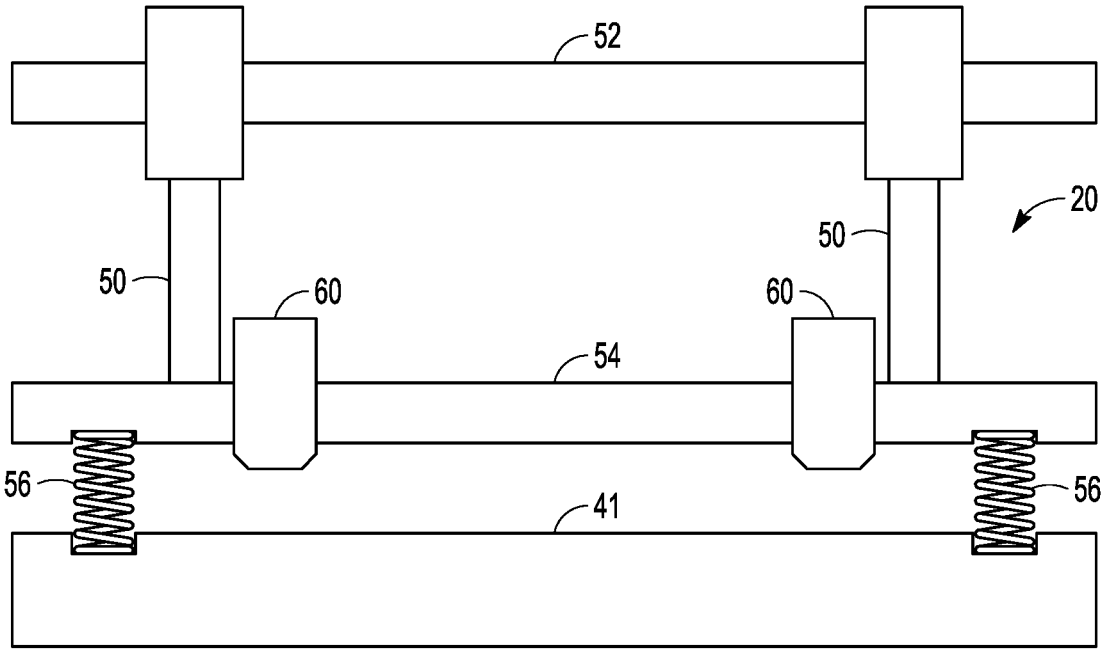
FIG. 5 shows front view of a tamper bar assembly, in accordance with one embodiment.

FIGS. 3, 4, and 5 show front views of the tamper bar assembly 20, in accordance with one embodiment. In this example the tamper bar assembly 20 can further include one or more adjustable stop members 60 to ensure certain amplitude performance of the tamper bar 41.

For example, the tamper bar assembly 20 further includes the one or more adjustable stop members 60 located on the plate 54. The one or more adjustable stops members 60 are positionable between the plate 54 and the tamper bar 41 in the various configurations shown in FIGS. 3, 4, and 5. In one example, the plate 54 can have two threaded holes 62, where adjustable stop members 60 are installed within the holes 62. The threaded holes 62 provide for easy adjustment of the adjustable stop members 56. The adjustable stop members 60 can be adjusted according to the paving thickness, so the distance from the adjustable stop members 60 to the tamper bar 41 can be varied.

FIG. 3 shows a configuration when the system is working with a medium amplitude. Here, a part of the energy of plate 54 movement will be used to compress the dampening members 56. However, the dampening members 56 may not be strong enough to push the tamper bar 41 down for all the movement of plate 54, so when the dampening members 56 are compressed, the adjustable stop members 60 will come in contact with the tamper bar 41, thus providing the desired amplitude of the tamper bar 41.

FIG. 4 shows a configuration when the system works with maximum amplitude. Here, the adjustable stop members 60 are adjusted so that there is no gap between plate 54 and tamper bar 41. In this case, the dampening members 56 will not work and the tamper bar 41 will simply move with the same amplitude as the plate 54.

FIG. 5 shows a configuration where the system works with minimum amplitude setting. In this example, the gap between adjustable stop members 60 and the tamper bar 41 is maximum. With this setting most of the movement of the plate 54 will compress the dampening members 56, and only when adjustable stop members 60 can come in contact with tamper bar 41, the tamper bar 41 will move with small amplitude. Most of the energy of the plate 54 movement will come to compress the dampening members 56, thus automatically reducing the amplitude working with thin mat layers.

As noted above, the tamper bar 41 will work normally even without adjustable stop members 60 if the dampening members 56 force is correct allowing for an automatic amplitude change depending on the thickness and hardness of the surface. The adjustable stop members 60 will just ensure that the system will work with the amplitude not less than desired.

In most cases the adjustable step members 60 can be adjusted to minimum amplitude (FIG. 5), and the amplitude will change automatically according to paved mat thickness because a thicker mat can absorb more energy than a thinner mat. Thus, for a thicker mat, instead of compressing the dampening members 56 most of the energy will come to the mat compaction. In a thinner mat, the converse will be true, and the tamper bar will have a minimum amplitude.

INDUSTRIAL APPLICABILITY

The present system is applicable to paving systems using tamper bar assemblies on the screed. As noted, although some screeds allow for manual adjustment of the amplitude of the tamper bar, it can be a time-consuming practice.

Here, the system provides for automatic amplitude adjustment depending the thickness or hardness of the material being paved. A method of operation will be discussed referring to FIGS. 1-5.

Figure 6:
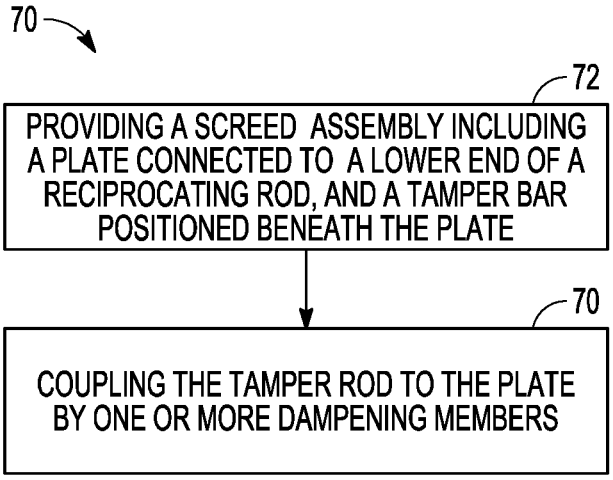
FIG. 6 shows a flowchart of a method of adjusting amplitude for a tamper bar, in accordance with one embodiment.

FIG. 6 shows a method (70) of adjusting amplitude for the tamper bar 41. The method 70 includes providing (72) the screed assembly 16 including the tamper bar assembly 20. The tamper bar assembly 20 includes the connecting rod 50 configured to have a reciprocating up and down motion, the plate 54 connected to a lower end of the connecting rod 50, and the tamper bar 41 positioned beneath the plate 54.

The method 70 further includes coupling (74) the tamper bar 41 to the plate 54 by connecting one or more dampening members 56 between the plate 54 and the tamper bar 41.

In some examples, the dampening member 56 can be directly connected to both the plate 54 and the tamper bar 41 with there being no other connection between the tamper bar 41 and the plate 54 except the dampening member 56, such that the dampening member 56 absorbs some of the force created by the tamper bar 41 during compaction such that there is automatic amplitude adjustment of the tamper bar 41 depending on the hardness of the material being compacted.

In some examples, the tamper bar assembly 20 further includes one or more adjustable stop members 60 located on the plate 54. The one or more adjustable stops members 60 can positionable between the plate 54 and the tamper bar 41 and wherein the one or more adjustable stops members 60 are adjustable such that a distance between the one or more adjustable stop members 60 and the tamper bar 41 can be varied.

The present system of automatic amplitude adjustment allows for the quality of a paving job to be improved on many jobsites without requiring action from the operator. For example, in some situations the customer paves binder course one day, and wear course on the other day. The present system allows the amplitude of the tamper bar to change automatically. The tamper bar amplitude will change to suit the material being compacted and provide better performance. For example, when the customer changes from normal paving thickness to big thickness (aggregate paving for example), by automatically increasing tamper bar amplitude it allows the screed to work with smaller angle of attack, thus reducing the screed plates wear. As noted above, since the dampening member 56 absorbs some of the force created by the tamper bar 41 there is automatic amplitude adjustment of the tamper bar 41 depending on the hardness of the material being compacted.

The above detailed description is intended to be illustrative, and not restrictive. The scope of the disclosure should, therefore, be determined with references to the appended claims, along with the full scope of equivalents to which such claims are entitled.

What is claimed is:

1. A paving machine comprising:
- a frame;
- a screed assembly coupled to the frame; and
- a tamper bar assembly located on the screed assembly, wherein the tamper bar assembly includes:
  - a connecting rod configured to have a reciprocating up and down motion;
  - a plate connected to a lower end of the connecting rod; and
  - a tamper bar positioned beneath the plate, wherein the tamper bar is coupled to the plate by one or more dampening members extending between the tamper bar and the plate.

2. The paving machine of claim 1, wherein the connecting rod is coupled to an eccentric rotating shaft.

3. The paving machine of claim 1, wherein the dampening members include one or more springs.

4. The paving machine of claim 1, wherein the one or more dampening members are directly connected to both the plate and the tamper bar.

5. The paving machine of claim 1, wherein there is no other connection between the tamper bar and the plate except the dampening member such that the dampening member absorbs some of the force created by the tamper bar such that there is automatic amplitude adjustment of the tamper bar depending on the hardness of the material being compacted.

6. The paving machine of claim 1, wherein the tamper bar assembly further includes one or more adjustable stop members located on the plate.

7. The paving machine of claim 6, wherein the one or more adjustable stops members are positionable between the plate and the tamper bar.

8. The paving machine of claim 7, wherein the one or more adjustable stops members are adjustable such that a distance between the one or more adjustable stop members and the tamper bar can be varied.

9. A screed assembly comprising:
- a screed frame;
- a screed plate coupled to the screed frame; and
- a tamper bar assembly coupled to the screed frame, wherein the tamper bar assembly includes:
  - a connecting rod configured to have a reciprocating up and down motion;
  - a plate connected to a lower end of the connecting rod; and
  - a tamper bar positioned beneath the plate, wherein the tamper bar is coupled to the plate by one or more dampening members extending between the tamper bar and the plate.

10. The screed assembly of claim 9, wherein the connecting rod is coupled to an eccentric rotating shaft.

11. The screed assembly of claim 9, wherein the dampening members include one or more springs.

12. The screed assembly of claim 9, wherein the dampening member is directly connected to both the plate and the tamper bar.

13. The screed assembly of claim 9, wherein there is no other connection between the tamper bar and the plate except the dampening member such that the dampening member absorbs some of the force created by the tamper bar such that there is automatic amplitude adjustment of the tamper bar depending on the hardness of the material being compacted.

14. The screed assembly of claim 9, wherein the tamper bar assembly further includes one or more adjustable stop members located on the plate.

15. The screed assembly of claim 14, wherein the one or more adjustable stops members are positionable between the plate and the tamper bar.

16. The screed assembly of claim 15, wherein the one or more adjustable stops members are adjustable such that a distance between the one or more adjustable stop members and the tamper bar can be varied.

17. A method of adjusting amplitude for a tamper bar comprising:

providing a screed assembly including a tamper bar assembly, wherein the tamper bar assembly includes a connecting rod configured to have a reciprocating up and down motion, a plate connected to a lower end of the connecting rod, and a tamper bar positioned beneath the plate; and coupling the tamper bar to the plate by connecting one or more dampening members between the plate and the tamper bar.

18. The method of claim 17, wherein the dampening member is directly connected to both the plate and the tamper bar with there being no other connection between the tamper bar and the plate except the dampening member, such that the dampening member absorbs some of the force created by the tamper bar such that there is automatic amplitude adjustment of the tamper bar depending on the hardness of the material being compacted.

19. The method of claim 17, wherein herein the tamper bar assembly further includes one or more adjustable stop members located on the plate.

20. The screed assembly of claim 19, wherein the one or more adjustable stops members are positionable between the plate and the tamper bar and wherein the one or more adjustable stops members are adjustable such that a distance between the one or more adjustable stop members and the tamper bar can be varied.

* * * * *